US008927929B1

(12) United States Patent
Nakano

(10) Patent No.: US 8,927,929 B1
(45) Date of Patent: Jan. 6, 2015

(54) MASS SPECTROMETER

(71) Applicant: Shimadzu Corporation, Kyoto, Kyoto (JP)

(72) Inventor: Tomohito Nakano, Nishikyo-ku (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 14/296,844

(22) Filed: Jun. 5, 2014

(30) Foreign Application Priority Data

Sep. 3, 2013 (JP) ..... 2013-181822

(51) Int. Cl.
*H01J 49/00* (2006.01)
*H01J 49/04* (2006.01)

(52) U.S. Cl.
CPC ..... *H01J 49/0409* (2013.01)
USPC ..... 250/288; 250/281; 250/282; 250/289; 250/423 R; 250/424

(58) Field of Classification Search
USPC ..... 250/281, 282, 288, 289, 423 R, 424
See application file for complete search history.

(56) References Cited

U.S. PATENT DOCUMENTS 4,388,531 A * 6/1983 Stafford et al. ..... 250/427
4,447,728 A * 5/1984 Stafford et al. ..... 250/423 R
5,686,655 A * 11/1997 Itoi ..... 73/23.37
5,753,795 A * 5/1998 Kuypers ..... 73/23.37
6,331,713 B1 * 12/2001 Smick et al. ..... 250/497.1
6,653,624 B2 * 11/2003 Fukuda et al. ..... 250/288
7,427,750 B2 * 9/2008 Grossenbacher et al. .... 250/288
7,960,711 B1 * 6/2011 Sheehan et al. ..... 250/493.1
8,153,992 B2 * 4/2012 Horiike et al. ..... 250/423 R
8,354,636 B2 * 1/2013 Nakano ..... 250/288
8,759,757 B2 * 6/2014 Hardman et al. ..... 250/288
2005/0247870 A9 * 11/2005 Park ..... 250/288
2007/0108381 A1 * 5/2007 Kuypers ..... 250/288
2010/0219336 A1 * 9/2010 Hofstadler et al. ..... 250/282
2010/0301200 A1 * 12/2010 Howes et al. ..... 250/282
2010/0301207 A1 * 12/2010 Howes et al. ..... 250/288
2011/0204223 A1 * 8/2011 Nakano ..... 250/288
2013/0243412 A1 * 9/2013 Nakano ..... 392/485

FOREIGN PATENT DOCUMENTS

JP 2001-343363 A 12/2001

OTHER PUBLICATIONS

"Agilent 5975 Series MSD Troubleshooting and Maintenance Manual" © 2012.*
"High-Sensitivity & High-Speed Scanning at 30,000 u/sec", http://www.shimadzu.ch/lcms-8050, searched May 26, 2014.

(Continued)

*Primary Examiner* — Michael Logie
(74) *Attorney, Agent, or Firm* — Sughrue Mion, PLLC

(57) ABSTRACT

An ionization chamber side voltage contact point is formed so as to protrude from the compartment in the ionization chamber, a mass spectrometric unit side voltage contact point 92 is formed in the hole created in the housing of the mass spectrometric unit, and a predetermined distance is provided between the inner periphery of the hole and the outer periphery of the mass spectrometric unit side voltage contact point in the structure, which allows the ionization chamber side voltage contact point to be inserted into the hole so to be connected to the mass spectrometric unit side voltage contact point when the ionization chamber is in the analysis position and allows the ionization chamber side voltage contact point to be pulled out from the hole so as to be disconnected from the mass spectrometric unit side voltage contact point the ionization chamber is in the maintenance position.

4 Claims, 6 Drawing Sheets

(56) References Cited

OTHER PUBLICATIONS

"UF Technologies Combine Sensitivity and High Speed" http://www.shimadzu.ch/uf-technologies-combine-sensitivity-and-high-speed searched: May 26, 2014.

Shimadzu's New Triple Quadrupole LCMS-8050 Mass Spectrometer Offers Combination of Outstanding Sensitivity With Ultra-fast, Accurate Analysis, http://www.ssi.shimadzu.com/news/newsEventsRelease.cfm?press2012.id=69 searched: Jan. 7, 2014.

* cited by examiner (a)

(b)

MASS SPECTROMETER

TECHNICAL FIELD

The present invention relates to a mass spectrometer having an ionization chamber and, in particular, to a liquid chromatograph mass spectrometer having an ionization chamber for ionizing a liquid sample that has been eluted from a liquid chromatographic unit and a mass spectrometric unit into which ions are introduced from the ionization chamber.

BACKGROUND ART

Liquid chromatograph mass spectrometers (LC/MS) are formed of a liquid chromatographic unit (LC unit) for separating a liquid sample into components, each of which is eluted, an ionization chamber (interface unit) for ionizing a sample component that has been eluted from the LC unit and a mass spectrometric unit (MS unit) for detecting ions that have been introduced from the ionization chamber. In such an ionization chamber various ionization techniques for ionizing a liquid sample are used and, in particular, atmospheric pressure ionization methods, such as the atmospheric pressure chemical ionization method (APCI) and the electrospray ionization method (ESI), are widely used.

Concretely, in the APCI the tip of a nozzle connected to the end of the column in the LC unit is placed so as to be directed toward the inside of the ionization chamber and, at the same time, a needle electrode is provided in front of the tip of the nozzle. Thus, a droplet of a sample that has been atomized through heating in the nozzle is made to chemically react with carrier gas ions (buffer ions) generated through corona discharge from the needle electrode so as to be ionized. In addition, in the ESI the tip of the nozzle connected to the end of the column in the LC unit is placed so as to be directed towards the inside of the ionization chamber and, at the same time, a high voltage of approximately 5 kV is applied to the tip portion of the nozzle so that a strong non-uniform electrical field is generated. As a result, the liquid sample is subjected to charge separation by means of the electrical field and, thus, is torn apart through Coulomb attraction so as to be atomized. As a consequence, the solvent in the droplet of the sample evaporates through contact with the surrounding air and, thus, gas ions are generated.

As described above, in the APCI and ESI, the liquid sample is ionized in a state that is close to atmospheric pressure and, therefore, a structure is adopted such that a middle chamber is provided between the ionization chamber and the MS unit so that the degree of vacuum can be increased step by step in order to maintain a difference in pressure between the ionization chamber in a high pressure state (that is, a state close to atmospheric pressure) and the MS unit in a very low pressure state (that is, a state of a vacuum of a high degree) (see Patent Document 1).

The applicant has announced on Internet websites technologies for increasing the sensitivity in and the ease of maintenance of a liquid chromatograph mass spectrometer (see Non-patent Documents 1 to 4).

FIG. 8 is a schematic diagram showing an example of the structure of a liquid chromatograph mass spectrometer using an ESI method. FIG. 9 is a perspective diagram showing the liquid chromatograph mass spectrometer of FIG. 8.

The liquid chromatograph mass spectrometer has an ionization chamber 200, a mass spectrometric unit 50, a control chamber 160 and a housing unit 170.

The ionization chamber 200 has a compartment 210 in a triangular prismatic form made of aluminum, and the compartment 210 has an upper surface 210*a*, a first side, a second side, a third side and a lower surface. In addition, a circular opening is created in the center portion of the first side and the peripheral portion of the opening in the first side is attached in an airtight manner to the front surface of a first middle chamber 12 via an O ring made of rubber (not shown). Furthermore, a spray unit (ionization member) 15 is attached to the upper surface 210*a* of the compartment 210.

The control chamber 160 is located beneath the ionization chamber 200 and has a control chamber housing 161 in a rectangular parallelepiped form wherein a high voltage power supply 62 is provided inside of the control chamber housing 161. In addition, one end portion of a cable 63 is connected to the high voltage power supply 62 inside of the control chamber housing 161 and, at the same time, the other end portion of the cable 63 is connected to a connector 65, which is placed outside of the control chamber housing 161.

The liquid sample that has been separated into components in the LC unit is supplied to the spray unit 15 through a pipe 155. Though not shown, a nebulizing gas (nitrogen gas) is supplied to the spray unit 15 from a nebulizing gas supplying source through a pipe having a diameter of 3.2 mm for example. As a result, the liquid sample and the nebulizing gas are led to the spray unit 15 so as to be sprayed. At this time a connector 67 of a cable 64 connected to the spray unit 15 and the connector 65 of the cable 63 connected to the high voltage power supply 62 are connected to each other so that a high voltage of 5 kV is applied to the tip of the nozzle of the spray unit 15 from the high voltage power supply 62 and, thus, ionization can be achieved.

Though FIG. 8 shows a spray unit 15 for ESI, generally the spray unit 15 is removable from the compartment 210 and in the case wherein the APCI method is used, the spray unit 15 for ESI is removed and instead a spray unit for APCI where a needle electrode for discharge can be treated as a unit is attached to the compartment 210.

The mass spectrometric unit 50 is provided with a first middle chamber (vacuum introduction unit) 12 that is adjacent to the ionization chamber 200, a second middle chamber 13 that is adjacent to the first middle chamber 12 and a mass spectrometric chamber (MS unit) that is adjacent to the second middle chamber 13 in a manner wherein these chambers are connected to each with respective partitions there between.

The mass spectrometric unit 50 is provided with a housing 190 made of aluminum in a parallelepiped form of 15 cm×15 cm×90 cm, wherein a first ion lens 21 is provided inside the first middle chamber 12 and, at the same time, a discharge opening 31 for vacuum discharge by means of an oil-sealed rotary pump (RP) is provided at the bottom of the first middle chamber 12.

A heater block 20 having a built-in temperature adjustment mechanism (not shown) is fixed to the front surface of the housing 190, where a solvent removal tube 19 in a circular tubular form (an outer diameter of 1.6 mm and an inner diameter of 0.5 mm) is formed in the heater block 20. As a result, the inside of the compartment 210 and the inside of the housing 190 are connected to each other via the solvent removal tube 19. Therefore, the solvent removal tube 19 has such functions that removal of solvent and ionization are accelerated through heating and through collision when ions and fine droplets of the sample sprayed from the spray unit 15 pass through the inside thereof.

An octupole 23 and a focus lens 24 are provided inside the second middle chamber 13, and a discharge opening 32 for vacuum discharge by means of a turbo molecular pump (TMP) is provided beneath the second middle chamber 13.

An entry lens 25 having a small hole is provided in the partition between the second middle chamber 13 and the mass spectrometric chamber 14 so that the inside of the second middle chamber 13 and the inside of the mass spectrometric chamber 14 are connected via this small hole.

A first quadrupole 16, a second quadrupole 17 and a detector 18 are provided inside the mass spectrometric chamber 14 and a discharge opening 33 for vacuum discharge by means of the turbo molecular pump (TMP) is provided at the bottom of the mass spectrometric chamber 14.

In this liquid chromatograph mass spectrometer, ions generated in the ionization chamber 200 are sent to the mass spectrometric chamber 14 after passing through the solvent removal tube 19, the first ion lens 21 within the housing 190 in the first middle chamber 12, a skimmer 22, the octupole 23 and the focus lens 24 within the second middle chamber 13, and the entry lens 25 in this order, where unnecessary ions are discharged by means of quadrupoles 16 and 17 so that only specific ions that have reached the detector 18 are detected.

Incidentally, in the above described liquid chromatograph mass spectrometer, the first ion lens 21 and the like require maintenance and, therefore, the structure allows the ionization chamber 200 to be treated as a unit so that the ionization chamber 200 can be moved between the maintenance position and the analysis position. For example, the ionization chamber 200 is rotatable by approximately 90° around the axis along the side between the first side and the front of the first middle chamber 12 in the vertical direction by means of a hinge (not shown). As a result, the user disconnects the connector 67 of the cable 64 connected to the spray unit 15 from the connector 65 of the cable 63 connected to the high voltage power supply 62 and removes the spray unit 15 in order to maintain the first ion lens 21 and the like and, after that, puts the ionization chamber 200 in the maintenance position and attaches the spray unit 15 for spectrometry followed by reconnection between the connector 67 of the cable 64 connected to the spray unit 15 and the connector 65 of the cable 63 connected to the high voltage power supply 62 and, then, puts the ionization chamber 200 in the analysis position.

PRIOR ART DOCUMENTS

Patent Document

Patent Document 1: Japanese Unexamined Patent Publication 2001-343363

Non-Patent Documents

Non-patent Document 1: http://www.shimadzu.co.jp/news/press/n00 kbc00000038uu.html Non-patent Document 2: http://www.an.shimadzu.co.jp/lcms/lcms8050/index.htm Non-patent Document 3: http://www.an.shimadzu.co.jp/lcms/lcms8050/uf-technology.htm Non-patent Document 4: http://www.an.shimadzu.cojp/lcms/lcms8050/product-design.htm

SUMMARY OF THE INVENTION

Problem to be Solved by the Invention

In the liquid chromatograph mass spectrometer as described above, it is necessary to connect and disconnect the connector 65 to and from the connector 67 for switching between the spray for ESI and the spray for APCI or for maintenance or spectrometry, which is quite troublesome and takes a long time and, thus, becomes a problem.

Means for Solving Problem

In order to solve the above described problem the present inventor examined the possibility of a liquid chromatograph mass spectrometer wherein the spray unit 15 and the high voltage power supply 62 are automatically connected to each other when the ionization chamber 200 is put in the analysis position and the spray unit 15 and the high voltage power supply 62 are automatically disconnected from each other when the ionization chamber 200 is put in the maintenance position. A high voltage is applied to the spray unit 15 and, therefore, the voltage contact point needs a creepage distance and an air clearance. Meanwhile, it is costly to increase the number of parts to provide such a mechanism.

Therefore, the inventor discovered it effective to form an ionization chamber side voltage contact point in a compartment of the ionization chamber and to form a mass spectrometric unit side voltage contact point in the hole created in the housing of the mass spectrometric unit. The inventor also discovered that a predetermined distance (gap) is provided between the inner periphery of the hole and outer periphery of the mass spectrometric unit side voltage contact point so that the mass spectrometric unit side voltage contact point can freely move by the same distance as the gap and, thus, the positional misalignment between the ionization chamber side voltage contact point and the mass spectrometric unit side voltage contact point can be tolerated (floating structure).

The mass spectrometer according to the present invention is a mass spectrometer provided with an ionization chamber having an ionization unit for ionizing a sample, a mass spectrometric unit to which ions are introduced from the above described ionization chamber and a power supply for supplying power to the above described ionization unit, wherein the above described ionization chamber can be moved to a maintenance position for maintaining the above described mass spectrometric unit and to a analysis position for analyzing the above described sample, an ionization chamber side voltage contact point is formed in a compartment of the above described ionization chamber so as to protrude, a mass spectrometric unit side voltage contact point is formed in a hole created in a housing of the above described mass spectrometric unit, a predetermined distance is provided between the inner periphery of the above described hole and the outer periphery of the above described mass spectrometric unit side voltage contact point, and the above described ionization chamber side voltage contact point is inserted into the above described hole so as to be connected to the above described mass spectrometric unit side voltage contact point when the above described ionization chamber is put into the above described analysis position and the above described ionization chamber side voltage contact point is pulled out from the above described hole so as to be disconnected from the above described mass spectrometric unit side voltage contact point when the above described ionization chamber is put into the above described maintenance position.

Here, a "predetermined distance" is a distance that makes it possible for the ionization chamber side voltage contact point to be inserted into the hole when the mass spectrometric unit side voltage contact point moves even in the case wherein there is a slight positional misalignment between the ionization chamber side voltage contact point and the mass spectrometric unit side voltage contact point when the ionization chamber is moved from the maintenance position to the analysis position and is determined through orbit calculation and the like by the designer. For example, it is preferable for a distance of 0.25 mm or more and 1.5 mm or less to be provided between the inner periphery of the hole and the outer periphery of the mass spectrometric unit side voltage contact point.

Effects of the Invention

As describe above, in the mass spectrometer according to the present invention, which is made of a small number of parts, the ionization unit and the power supply are automatically connected to each other when the ionization chamber is put into the analysis position and the ionization unit and the power supply are automatically from each other when the ionization chamber is put into the maintenance position. As a result, costs can be reduced and, in addition, ease of maintenance can be improved. In addition, a predetermined distance (gap) is provided between the inner periphery of the hole and the outer periphery of the mass spectrometric unit side voltage contact point so that the mass spectrometric unit side voltage contact point can freely move by the same distance as the gap and, thus, the ionization chamber can be moved smoothly even in the case wherein there is a positional misalignment between the ionization chamber side voltage contact point and the mass spectrometric unit side voltage contact point.

Other Means for Solving Problem and Effects Thereof

In addition, in the mass spectrometer according to the present invention, the above described ionization chamber may be provided with a compartment in a rectangular parallelepiped form having a rear surface linked to the front surface of the housing of the above described mass spectrometric unit, an upper surface, a front surface, a right surface, a left surface and a lower surface, the above described ionization chamber may be rotatable around an axis of a side of the above described rear surface in the vertical direction, the above described ionization chamber side voltage contact point may be formed so as to protrude from the rear surface of the above described compartment in the horizontal direction, and the above described mass spectrometric unit side voltage contact point may be formed in a hole created in the front surface of the above described housing in the horizontal direction.

Furthermore, in the mass spectrometer according to the present invention, the above described ionization chamber side voltage contact point may be a plug made of a metal and, at the same time, the above described mass spectrometric unit side voltage contact point may be a socket made of a metal, or the above described ionization chamber side voltage contact point may be a socket made of a metal and, at the same time, the above described mass spectrometric unit side voltage contact point may be a plug made of a metal, and the above described plug made of a metal may be placed inside a cylinder formed of an insulating material and, at the same time, the outer periphery of the above described socket made of a metal may be covered by a cylinder formed of an insulating material.

PREFERRED EMBODIMENTS

In the following the embodiments of the present invention are described in reference to the drawings. Here, the present invention is not limited to the below described embodiments but includes, of course, various modifications as long as the gist of the present invention is not deviated from.

Figure 1:
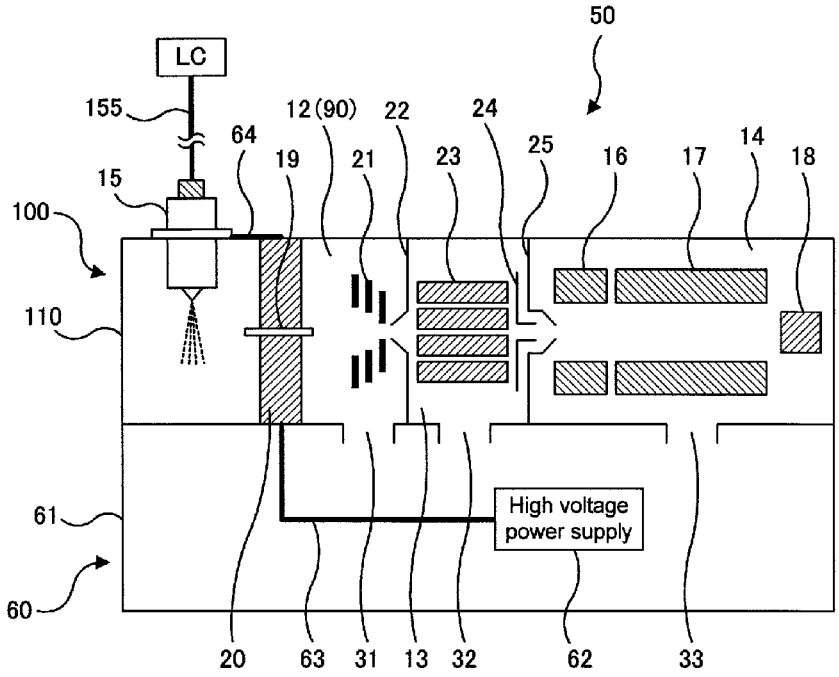
FIG. 1 is a schematic diagram showing an example of the structure of a liquid chromatograph mass spectrometer using an ESI method according to the present invention.
Figure 2:
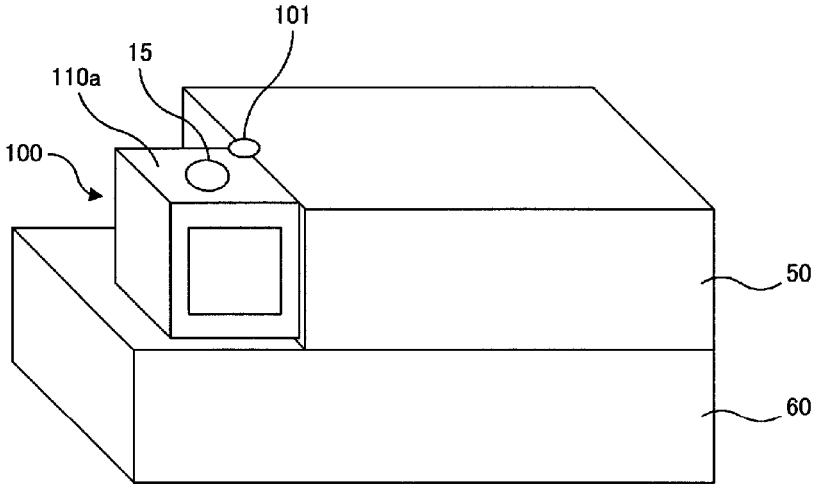
FIG. 2 is a perspective diagram showing the liquid chromatograph mass spectrometer of FIG. 1.
Figure 3:
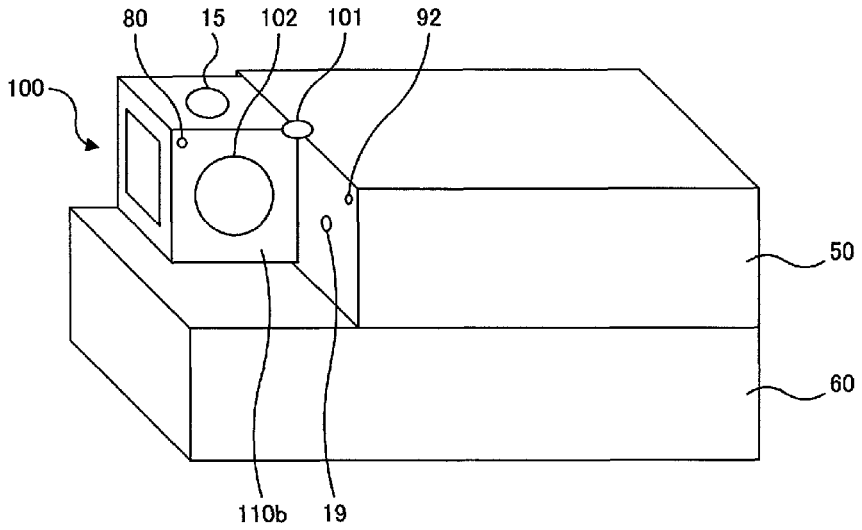
FIG. 3 is a perspective diagram showing the liquid chromatograph mass spectrometer of FIG. 1.
Figure 4:
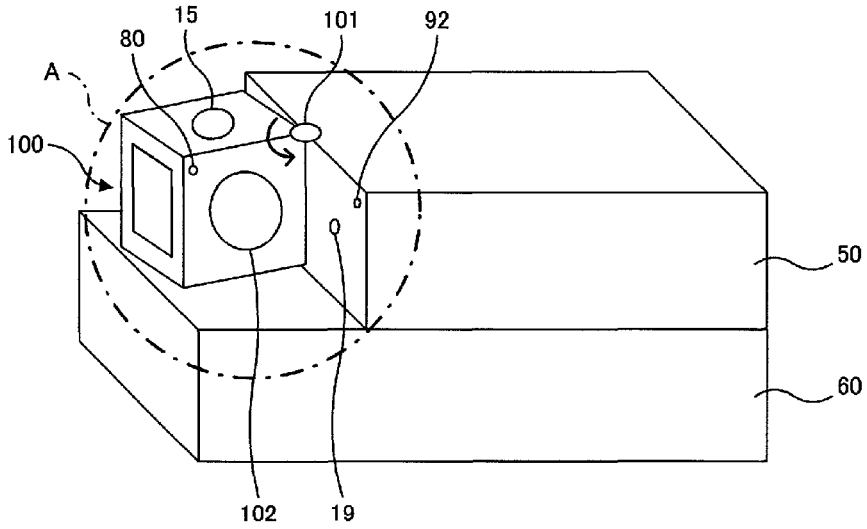
FIG. 4 is a perspective diagram showing the liquid chromatograph mass spectrometer of FIG. 1.
Figure 5:
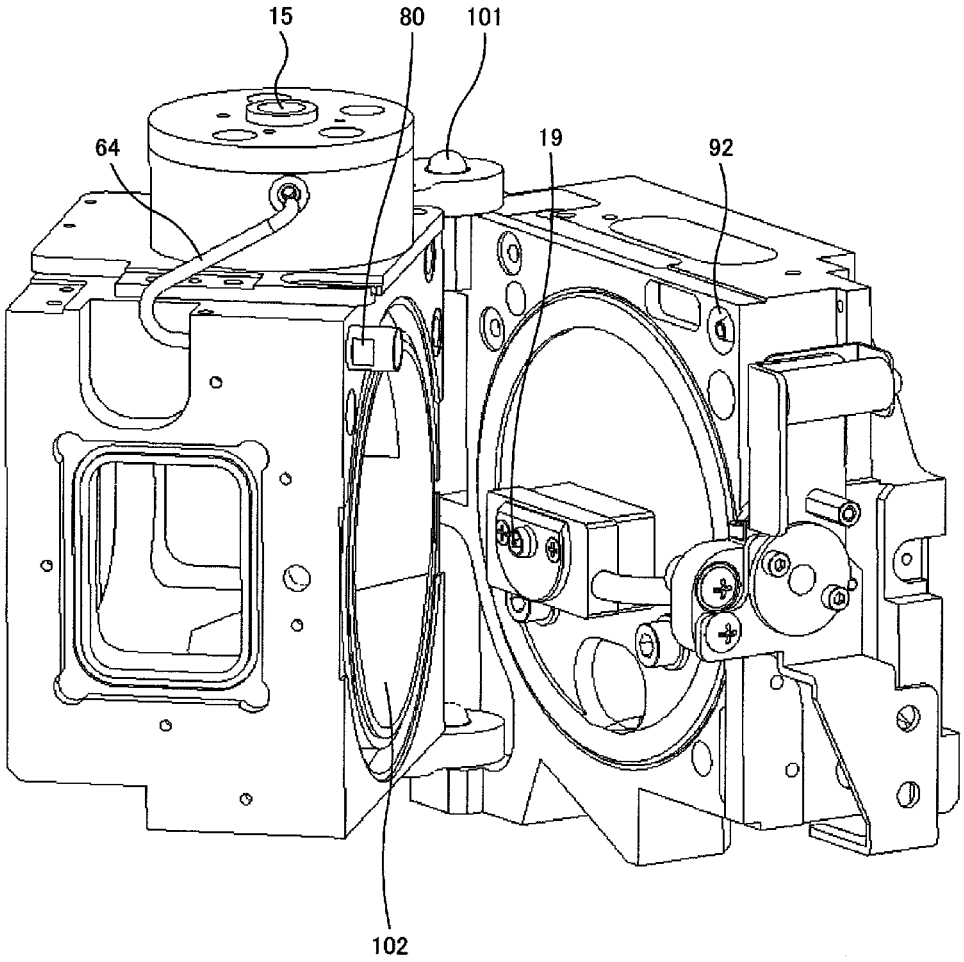
FIG. 5 is a perspective diagram showing an enlargement of A in FIG. 4.

FIG. 1 is a schematic diagram showing an example of the structure of a liquid chromatograph mass spectrometer using an ESI method according to the present invention. FIGS. 2 through 4 are perspective diagrams showing the liquid chromatograph mass spectrometer of FIG. 1. FIG. 5 is a perspective diagram showing an enlargement of A in FIG. 4. Here, FIG. 2 is a diagram wherein the ionization chamber is put into the analysis position. FIG. 3 is a diagram wherein the ionization chamber is put into the maintenance position. FIGS. 4 and 5 are diagrams wherein the ionization chamber is being moved. In addition, the same symbols as in the above described conventional liquid chromatograph mass spectrometer are attached to the corresponding components in the drawings.

The liquid chromatograph mass spectrometer has an ionization chamber 100, a mass spectrometric unit 50 and a control chamber 60.

The mass spectrometric unit 50 has a housing 90 made of aluminum in a rectangular parallelepiped for of 15 cm×15 cm×90 cm, wherein a first ion lens 21 is provided inside of the first middle chamber 12 and, at the same time, a discharge opening 31 for vacuum discharge by means of an oil-sealed rotary pump (RP) is provided beneath the first middle chamber 12.

A heater block 20 having a built-in temperature adjustment mechanism (not shown) is fixed to the front surface of the housing 90 and a solvent removal tube 19 in a circular tubular form (an outer diameter of 1.6 mm and an inner diameter of 0.5 mm) is created in the heater block 20. As a result the inside of the compartment 110 and the inside of the housing 90 are connected to each other via the solvent removal tube 19.

Figure 6:
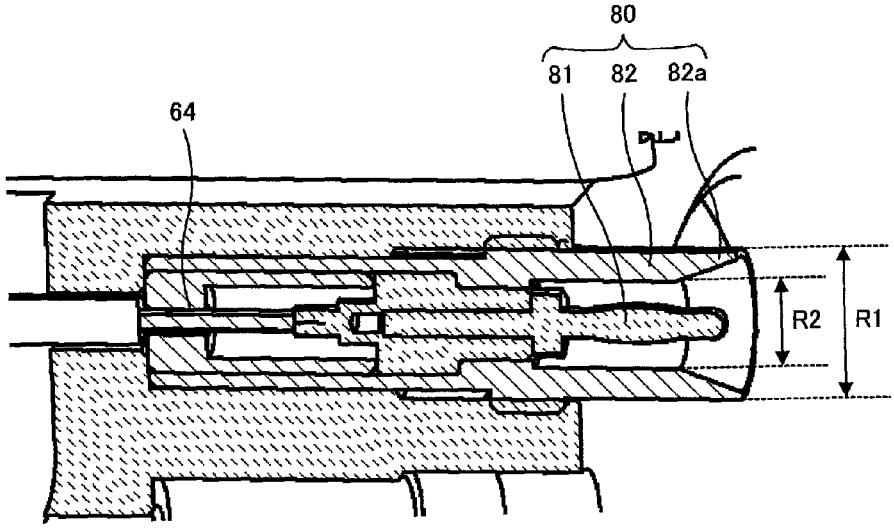
FIGS. 6(*a*) and 6(*b*) are cross sectional diagrams showing enlargements of the ionization chamber side voltage contact point and the mass spectrometric unit side voltage contact point.
Figure 6:
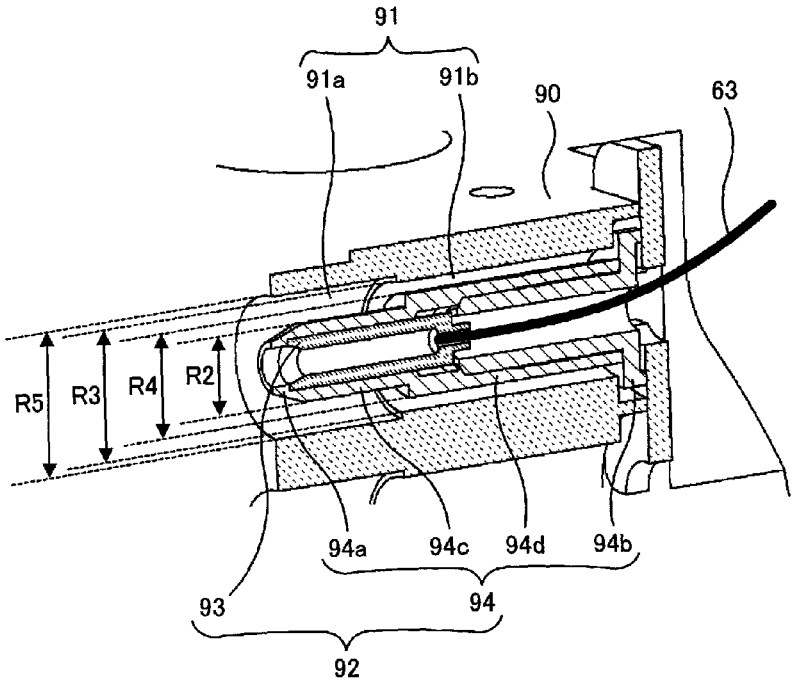

In addition, a hole 91 is created in the upper right portion of the front surface of the housing 90 in the horizontal direction (toward the rear). The hole 91 has a two-step structure consisting of a front hole 91*a* having a diameter $R_5$=11 mm and a rear hole 91*b* having a diameter $R_3$=10 mm, and a mass spectrometric unit side voltage contact point 92 is provided inside of the hole 91. FIG. 6(*b*) is a cross sectional diagram showing an enlargement of the mass spectrometric unit side voltage contact point 92.

The mass spectrometric unit side voltage contact point 92 has a socket 93 made of a metal and a cylinder 94 made of a resin (insulating material). The socket 93 made of a metal is a cylinder having an outer diameter of 4 mm and an inner diameter of 2 mm, for example, and is placed inside of the hole 91 so that the center axis of the socket 93 made of a metal and the center axis of the hole 91 become in approximate agreement. In addition, the cylinder 94 has a two-step structure consisting of a front cylinder 94*c* having an outer diameter $R_2$=6 mm and an inner diameter of 4 mm and a rear cylinder 94*d* having an outer diameter $R_4$=8 mm and an inner diameter of 5 mm and, thus, covers the outer periphery of the socket 93 made of a metal. That is to say, a predetermined distance $((R_3-R_4)/2)$ is provided between the inner periphery of the rear hole 91*b* and the outer periphery of the rear cylinder 94*d* so that the mass spectrometric unit side voltage contact point 92 can move by the distance $(R_3-R_4)$ in the direction of the radius (floating structure). It is preferable for this distance $(R_3-R_4)$ to be 0.5 mm or more and 3 mm or less.

Here, the front side of the front cylinder 94*c* is tapered around the outer periphery so as to provide a tapered portion 94*a* where the outer diameter becomes gradually smaller towards the front. In addition, a flange 94*b* is formed so as to protrude from the outer periphery of the rear cylinder 94*d* in the radius direction on the rear side so that the mass spectrometric unit side voltage contact point 92 is fixed so as not to move in the front to rear direction.

A control chamber 60 is provided beneath the ionization chamber 100 and has a control chamber housing 61 in a rectangular parallelepiped form. A high voltage power supply 62 is provided inside the control chamber housing 61. In addition, one end portion of the cable 63 is connected to the high voltage power supply 62 inside the control chamber housing 61 and, at the same time, the other end portion of the cable 63 is connected to the rear of the socket 93 made of a metal formed within the housing 90.

The ionization chamber 100 has a compartment 110 made of aluminum in a rectangular parallelepiped form of 13 cm×13 cm×12 cm and the compartment 110 has an upper surface 110*a*, a rear surface 110*b*, a front surface, a right surface, a left surface and a lower surface. In addition, a circular opening 102 is created in the center portion of the rear surface 110*b*, and the periphery portion of the opening 102 in the rear surface 110*b* is attached in an airtight manner to the front surface of the first middle chamber 12 via an O ring made of rubber (not shown).

In addition, an ionization chamber side voltage contact point 80 is formed in the upper right portion of the rear surface 110*b* so as to protrude in the horizontal direction (toward the rear) by 10 mm or more and 11 mm or less, for example. FIG. 6(*a*) is a cross sectional diagram showing an enlargement of the ionization chamber side voltage contact point 80.

The ionization chamber side voltage contact point 80 has a cylinder 82 made of a resin (insulating material) and a plug 81 made of a metal. The cylinder 82 has an outer diameter $R_1$=10 mm and an inner diameter $R_2$=6 mm, for example, and a tapered portion 82*a* of which the inner diameter increases gradually towards the rear is provided around the inner periphery on the rear side. In addition, the plug 81 made of a metal is approximately in a columnar form having a diameter of 2 mm, for example, and is placed inside the cylinder 82 so that the center axis of the plug 81 made of a metal and the center axis of the cylinder 82 are in approximate agreement.

Here, it is preferable for the distance $(R_5-R_1)$ to be 0.5 mm or more and 3 mm or less. In addition, the front side of the plug 81 made of a metal is connected to the spray unit 15 via a cable 64, and the plug 81 made of a metal can be inserted into and engaged with the socket 93 made of a metal for connection.

The spray unit (ionization unit) 15 is attached to the upper surface 110*a* of the compartment 110. The liquid sample separated into components by the LC unit is supplied to the spray unit 15 via a pipe 155. Though not shown, nebulizing gas (nitrogen gas) is supplied to the spray unit 15 from a nebulizing gas supply source via a pipe having a diameter of 3.2 mm, for example. As a result, the liquid sample and the nebulizing gas are led to the spray unit 15 so as to be sprayed. At this time, the plug 81 made of a metal connected to the spray unit 15 and the socket 93 made of a metal connected to the high voltage power supply 62 are connected to each other so that a high voltage of 5 kV is applied from the high voltage power supply 62 to the tip of the nozzle of the spray unit 15 and, thus, ionization can be achieved.

In addition, the ionization chamber 100 can be moved between the maintenance position and the analysis position. Concretely, the ionization chamber 100 is rotatable by approximately 90° around an axis of one side between the rear surface 110*b* and the front surface of the first middle chamber 12 in the vertical direction by means of a hinge 101. As a result, the user can put the ionization chamber 100 into the maintenance position in order to maintain the first ion lens 21 and the like, or put the ionization chamber 100 into the analysis position in order to carry out analysis.

Here, the analysis state (normal usage state) and the maintenance state (during maintenance of the mass spectrometric unit) of the liquid chromatograph mass spectrometer according to the present invention are described.

(1) Maintenance State (See FIGS. 3 and 6)

The ionization chamber 100 is put into the maintenance position wherein the front surface of the first middle chamber 12 is open. At this time, the socket 93 made of a metal and the plug 81 made of a metal are disconnected from each other.

(2) From Maintenance State to Analysis State (See FIGS. 4 and 5)

As the ionization chamber 100 is rotated from the maintenance position to the analysis position, the ionization chamber side voltage contact point 80 is inserted into the hole 91. Concretely, the cylinder 82 having the outer diameter $R_1$ is inserted into the front hole 91*a* having the diameter $R_5$ so that the tapered portion 82*a* of the cylinder 82 makes contact with the tapered portion 94*a* of the front cylinder 94*c*. At this time, a predetermined distance $((R_3-R_4)/2)$ provided between the inner periphery of the rear hole 91*b* and the outer periphery of the rear cylinder 94*d* allows the rear cylinder 94*d* to move only by the distance $(R_3-R_4)$ in the radius direction and, thus, allows the ionization chamber 100 to rotate smoothly even in the case wherein there is a positional misalignment in the radius direction between the ionization chamber side voltage contact point 80 and the mass spectrometric unit side voltage contact point 92. Therefore, the plug 81 made of a metal is inserted into and engaged with the socket 93 made of a metal while the inner periphery of the cylinder 82 makes contact with the outer periphery of the front cylinder 94*c*.

Figure 7:
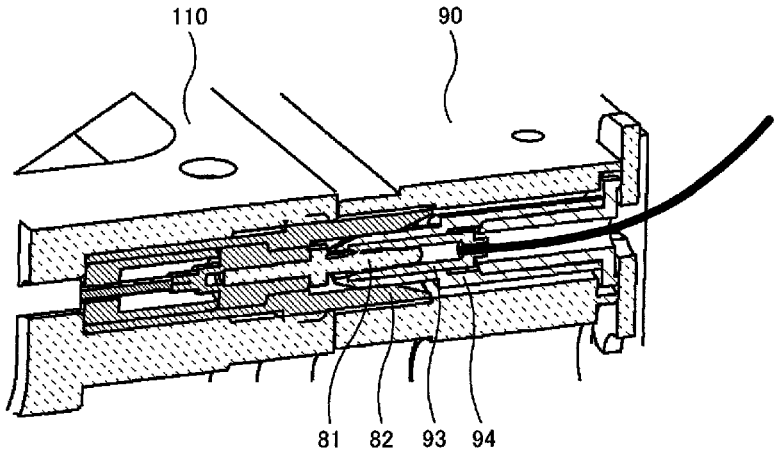
FIG. 7 is a cross sectional diagram showing an enlargement of the socket made of a metal and a plug made of a metal when connected.
Figure 8:
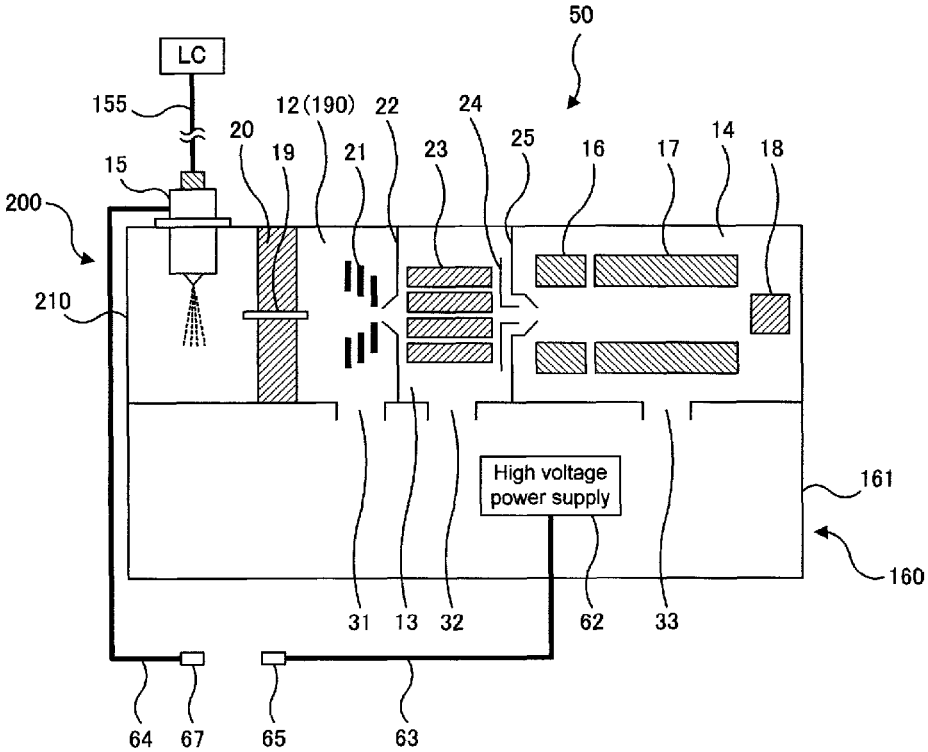
FIG. 8 Prior Art
FIG. 8 is a schematic diagram showing an example of the structure of a general liquid chromatograph mass spectrometer using an ESI method.
Figure 9:
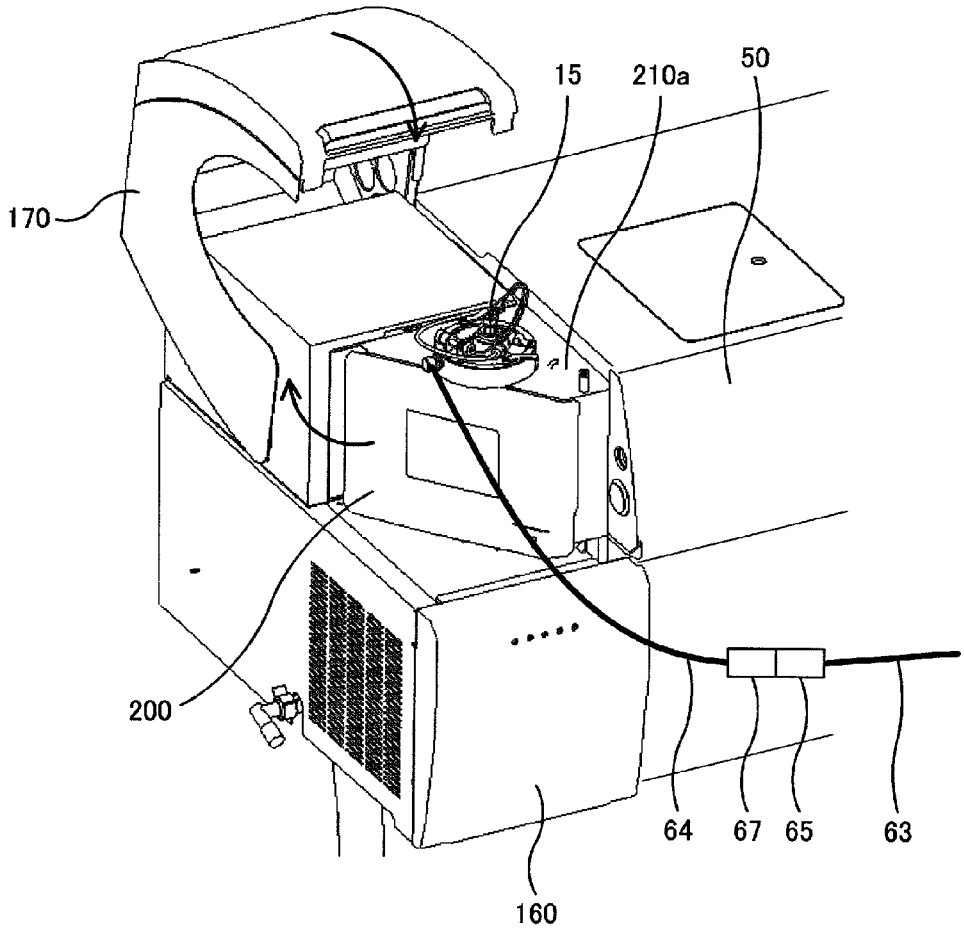
FIG. 9 Prior Art
FIG. 9 is a perspective diagram showing the liquid chromatograph mass spectrometer of FIG. 8.

(3) Analysis State (See FIGS. 2 and 7)

The ionization chamber 100 is put into the analysis position wherein the periphery portion of the opening 102 in the rear surface 110*b* is attached to the front surface of the first middle chamber 12 in an airtight manner. At this time, the socket 93 made of a metal and the plug 81 made of a metal are connected to each other. FIG. 7 is a cross sectional diagram showing an enlargement of the socket 93 made of a metal and the plug 81 made of a metal when connected to each other.

As described above, in the liquid chromatograph mass spectrometer according to the present invention, which has a small number of parts, the spray unit 15 and the high voltage power supply 62 are automatically connected to each other when the ionization chamber 100 is put into the analysis position and the spray unit 15 and the high voltage power supply 62 are automatically disconnected when the ionization chamber 100 is put into the maintenance position. Therefore, costs can be lowered and, in addition, ease of maintenance can be improved.

Other Embodiments

Though the above described liquid chromatograph mass spectrometer has such a structure that the mass spectrometric unit side voltage contact point 92 has a socket 93 made of a metal and, at the same time, the ionization chamber side voltage contact point 80 has a plug 81 made of a metal, the structure may allow the mass spectrometric unit side voltage contact point to have a plug made of a metal and may allow the ionization chamber side voltage contact point to have a socket made of a metal.

INDUSTRIAL APPLICABILITY

The present invention can be applied to mass spectrometers having an ionization chamber.

EXPLANATION OF SYMBOLS

15: spray unit (ionization unit)
19: solvent removal tube
50: mass spectrometric unit
60: control chamber
61: control chamber housing
62: high voltage power supply
80: ionization chamber side voltage contact point
90: housing
91: hole
92: mass spectrometric unit side voltage contact point
100: ionization chamber
110: compartment

What is claimed is:

1. A mass spectrometer, comprising an ionization chamber having an ionization unit for ionizing a sample, a mass spectrometric unit to which ions are introduced from said ionization chamber and a power supply for supplying power to said ionization unit, characterized in that said ionization chamber can be moved to a maintenance position for maintaining said mass spectrometric unit and to a analysis position for analyzing said sample, an ionization chamber side voltage contact point is formed in a compartment of said ionization chamber so as to protrude, a mass spectrometric unit side voltage contact point is formed in a hole created in a housing of said mass spectrometric unit, a predetermined distance is provided between the inner periphery of said hole and the outer periphery of said mass spectrometric unit side voltage contact point, and said ionization chamber side voltage contact point is inserted into said hole so as to be connected to said mass spectrometric unit side voltage contact point when said ionization chamber is put into said analysis position and said ionization chamber side voltage contact point is pulled out from said hole so as to be disconnected from said mass spectrometric unit side voltage contact point when said ionization chamber is put into said maintenance position.

2. The mass spectrometer according to claim 1, characterized in that said ionization chamber comprises a compartment in a rectangular parallelepiped form having a rear surface linked to the front surface of the housing of said mass spectrometric unit, an upper surface, a front surface, a right surface, a left surface and a lower surface, said ionization chamber is rotatable around an axis of a side of said rear surface in the vertical direction, said ionization chamber side voltage contact point is formed so as to protrude from the rear surface of said compartment in the horizontal direction, and said mass spectrometric unit side voltage contact point is formed in a hole created in the front surface of said housing in the horizontal direction.

3. The mass spectrometer according to claim 2, characterized in that said ionization chamber side voltage contact point is a plug made of a metal and, at the same time, said mass spectrometric unit side voltage contact point is a socket made of a metal, or said ionization chamber side voltage contact point is a socket made of a metal and, at the same time, said mass spectrometric unit side voltage contact point is a plug made of a metal, and said plug made of a metal is placed inside a cylinder formed of an insulating material and, at the same time, the outer periphery of said socket made of a metal is covered by a cylinder formed of an insulating material.

4. The mass spectrometer according to claim 1, characterized in that said ionization chamber side voltage contact point is a plug made of a metal and, at the same time, said mass spectrometric unit side voltage contact point is a socket made of a metal, or said ionization chamber side voltage contact point is a socket made of a metal and, at the same time, said mass spectrometric unit side voltage contact point is a plug made of a metal, and said plug made of a metal is placed inside a cylinder formed of an insulating material and, at the same time, the outer periphery of said socket made of a metal is covered by a cylinder formed of an insulating material.

* * * * *